US006244235B1

(12) United States Patent
Hegemier et al.

(10) Patent No.: US 6,244,235 B1
(45) Date of Patent: Jun. 12, 2001

(54) HEAVY-DUTY VALVE STEM SEAL ASSEMBLY

(75) Inventors: Timothy Alan Hegemier; Mark Allen Stamback, both of Avilla, IN (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/552,447

(22) Filed: Apr. 18, 2000

(51) Int. Cl.[7] ..... F02N 3/00
(52) U.S. Cl. ..... 123/188.6; 277/189
(58) Field of Search ..... 123/188.6; 277/189

(56) References Cited

U.S. PATENT DOCUMENTS 2,821,973 2/1958 Guhman .
4,325,558 4/1982 Poggio .
4,909,202 3/1990 Binford et al. .
5,174,256 12/1992 Binford .
5,237,971 8/1993 Worsley .

*Primary Examiner*—Noah P. Kamen
(74) *Attorney, Agent, or Firm*—Rader, Fishman & Grauer PLLC

(57) ABSTRACT

An integral valve stem seal retainer and spring seat for a valve seal subassembly is disclosed having lower, intermediate and upper portions. An annular sealing member is bonded to the intermediate and upper portions of the metal retainer and an annular flange extends radially outwardly of the lower portion of the retainer to engage at least one coil of a valve spring. The annular sealing member further includes upper and lower portions, wherein the upper portion engages an outer surface of a valve stem while the lower portion engages a top of a thin-walled valve guide.

12 Claims, 3 Drawing Sheets

HEAVY-DUTY VALVE STEM SEAL ASSEMBLY

HEAVY-DUTY VALVE STEM SEAL ASSEMBLY

The present application is related to U.S. application Ser. No. 09/395,579 filed Sep. 14, 1999, entitled "Heavy Duty Valve Stem Seal", the disclosure of which in hereby incorporated by reference.

FIELD OF THE INVENTION

The present invention relates to internal combustion engine valve seals and retainers, and more particularly to a unitary annular retainer including an integral spring seat where the retainer is integrally bonded to the retainer such that the retainer provides support to an entire outer circumference of a valve stem seal.

BACKGROUND OF THE INVENTION

In conventional overhead valve internal combustion engines, at least two valves reciprocate to provide intermittent communication between intake and exhaust manifolds and a combustion chamber. The valves include valve stems that are commonly disposed in valve stem guides, supporting axial motion in an engine component such as an engine head. Lubrication is provided to upper portions of the valve stems by a spray of lubricating oil within a valve cover disposed over the engine head or by gravity flow from an associated rocker arm. Oil flows along a free upper end of the valve stem toward the manifolds and valve heads by the force of gravity and may be encouraged by a pressure differential in the manifold versus crankcase pressure.

Annular valve stem seals are generally urged into contact with the outer surface of the valve stem and an upper portion of the valve guide by a valve stem seal retainer, and serve various purposes. First, valve stem seals minimize engine oil consumption by restricting oil entry into the manifold and the combustion chamber. Second, they help to minimize exhaust particulates that contribute to pollution. Third, they are helpful in minimizing guide wear, which is of particular importance in large diesel engines due to the nature of their operation. The valve stem, valve guide, and valve stem seals are annularly wrapped by a helical compression valve spring that serves to bias the valve into a closed position. The longitudinal ends of the valve spring are restrained by flanges on corresponding valve spring retainers and/or spring seats, thereby maintaining proper alignment and position of the valve and valve spring.

In the heavy-duty engine market a number of changes are being made to comply with recent and prospective emissions standards. As the construction of the engine changes, engine designers must nevertheless maintain a robust engine design with a sufficient level of dependability. One of the more prominent changes being implemented is the increase of the power rating of the engine in an effort to reduce the size of the engine. In particular, engine manufacturers are attempting to reduce the displacement of heavy-duty engines while still providing ample horsepower and torque for heavy-duty applications. As is well-known, engine displacement is calculated by multiplying cylinder bore area times the piston stroke length. In reducing the displacement of heavy-duty engines, manufacturers are reducing both the bore area and the stroke length while increasing the compression within the combustion chamber. Increasing the required amount of compression, in turn, places greater stress on the valve seal. Many of these engines are increasing their compression by up to 50–60 psig, which is a far greater pressure than many prior art valve seals can handle while being properly retained on a valve guide. For such cases, an integral valve seal with a metal retainer is normally recommended.

However, as the bore area of an engine is reduced, the area provided for valve assemblies above a combustion chamber is correspondingly reduced. The problem is especially significant in heavy-duty diesel engines because all valve assemblies are typically oriented perpendicular to the engine head. Additionally, a fuel injector occupies a large portion of the area above the cylinder bore. Thus, in high efficiency heavy-duty diesel engines having more than two valves (intake and exhaust valves) per cylinder, the area directly above the engine bore must be shared by a fuel injector and the valves. Since the size of the fuel injector is substantially fixed, a reduction in engine bore generally requires a reduction in the valve assembly diameter, including corresponding reductions in the diameter of valve stem seals, valve guides, and valve stem seal retainers. There is thus a need for a valve seal assembly capable of withstanding increased compression loads while providing a seal having close clearance and durability.

Another way manufacturers are attempting to comply with with recent and prospective emissions standards is by turbocharging heavy-duty diesel engines while also incorporating exhaust gas recirculation (EGR) to reduce emissions. In typical turbocharged, unthrottled (i.e. diesel) engines that do not have EGR, the intake manifold pressure is slightly higher than the exhaust manifold pressure. Thus, if the valve stem seal is strong enough to withstand the intake manifold pressure, it will also withstand the lower exhaust manifold pressure. However, once EGR is incorporated, the a portion of the exhaust gases are injected back into the intake manifold at a point downstream of the turbocharger compressor. To effectively inject exhaust gases into the intake manifold, the exhaust manifold pressure must exceed the intake manifold pressure. In one design, the exhaust manifold pressure must be 75–100 percent higher than the intake manifold pressure to achieve the desired level of exhaust gas recirculation. However, it has been found that prior art integral valve seal designs are insufficiently supported by the metal retainer to operate in high pressure environments. In particular, such a dramatic increase in exhaust manifold pressure has caused "bursting" of the valve seal in experimental turbocharged unthrottled engine designs using EGR, resulting in loss of compression and seal integrity. Thus, a reinforced integral valve seal assembly is desired that is capable of withstanding increased compression loads while also providing a seal having close clearance and durability to minimize the possibility of valve seal failure in high pressure environments.

SUMMARY OF THE INVENTION

The present invention is directed to an integral valve stem seal, valve stem seal retainer and spring seat designed to withstand high manifold pressures. The retainer includes concentric lower, intermediate and upper portions, where the portions are separated by diameter-reducing transition zones. As a result, the intermediate and upper portions both have an inside diameter less than the lower portion, while the upper portion has an inside diameter less than the intermediate portion. An elastomeric annular sealing member is bonded to the upper and intermediate portions of the metal retainer such that the entire outside diameter of the sealing member is reinforced by the retainer. An annular flange extends radially outwardly of the lower portion of the retainer to engage at least one coil of a valve spring. The annular sealing member includes a plurality of oil or gas seals that engage an outer surface of a valve stem, and further includes a lower lip that engages a top of a valve guide. The lower portion of the retainer may also include a plurality of radially inwardly extending tangs to positively engage an outer surface of the valve guide against axial and rotational movement.

Because the valve stem seal is reinforced along its entire outside diameter, the seal inventive seal is extremely strong and resistant to failure even though the outer diameter has been reduced to accommodate smaller, higher power-density engines. Moreover, since the uppermost reinforcement on the seal is provided by the upper retainer portion, which has the smallest inner diameter, the seal is extremely resistant to blow-out or "bursting". Thus, the seal of the present invention may be used in new, higher pressure heavy-duty engines to reduce the likelihood of valve stem seal failure.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF THE PREFERRED EMBODIMENTS

Figure 1:
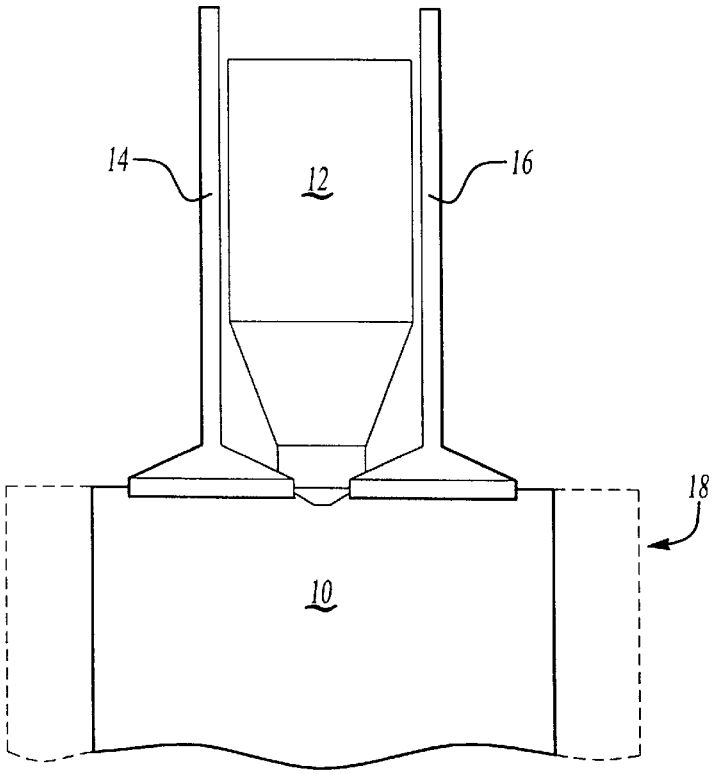
FIG. 1 is a side plan view of a cylinder bore of a heavy-duty high power density diesel engine.

As noted above, reducing the displacement of heavy-duty engines causes a corresponding reduction in a cylinder bore area. In FIG. 1, a side plan view of a reduced area cylinder bore 10 is shown. FIG. 1 also shows in plan view a fuel injector 12, and two valves 14, 16 corresponding respectively to intake and exhaust valves. As may be appreciated from FIG. 1, the valves 14, 16 extend generally perpendicular to the cross-sectional area of the cylinder bore 10, and are not angled with respect to the combustion chamber. In comparison to a conventionally sized heavy-duty engine cylinder bore, shown in phantom as reference 18, the reduced area bore 10 provides substantially less area above the bore 10 for placement of both the fuel injector 12 and the valves 14, 16.

Figure 2:
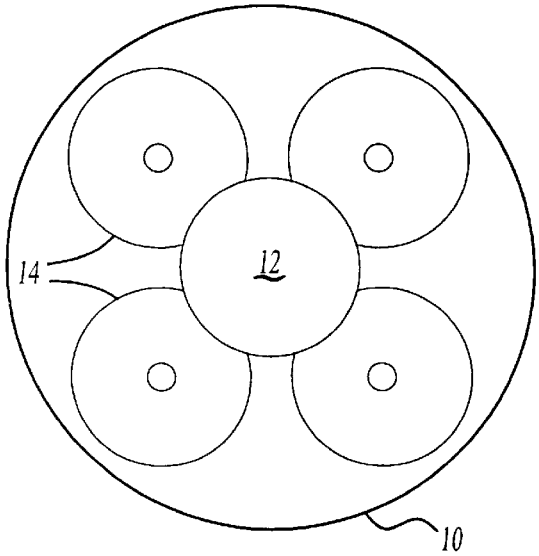
FIG. 2 is a top plan view of a cylinder bore of a heavy-duty high power density diesel engine.

The space constraints associated with heavy-duty high power density engines are further illustrated with reference to FIG. 2, which shows the reduced diameter bore 10 from the top. In FIG. 2, the fuel injector 12 shares the area directly above the cylinder bore 10 with two pairs of valve assemblies 14, 16 (two intake and two exhaust valves). Again, because the valve assemblies 14, 16 and the fuel injector 12 extend generally perpendicular to the cross-sectional area of the cylinder bore 10, the area allowed for each valve assembly 14, 16 is severely constrained. As may be appreciated, it is not practical to reduce the size of the fuel injector 12. To enable the four valve assemblies 14, 16 and the fuel injector 12 to fit within the allocated space above each cylinder bore 10, the corresponding cross-sectional area of the valve assemblies 14, 16 must be reduced.

Figure 3:
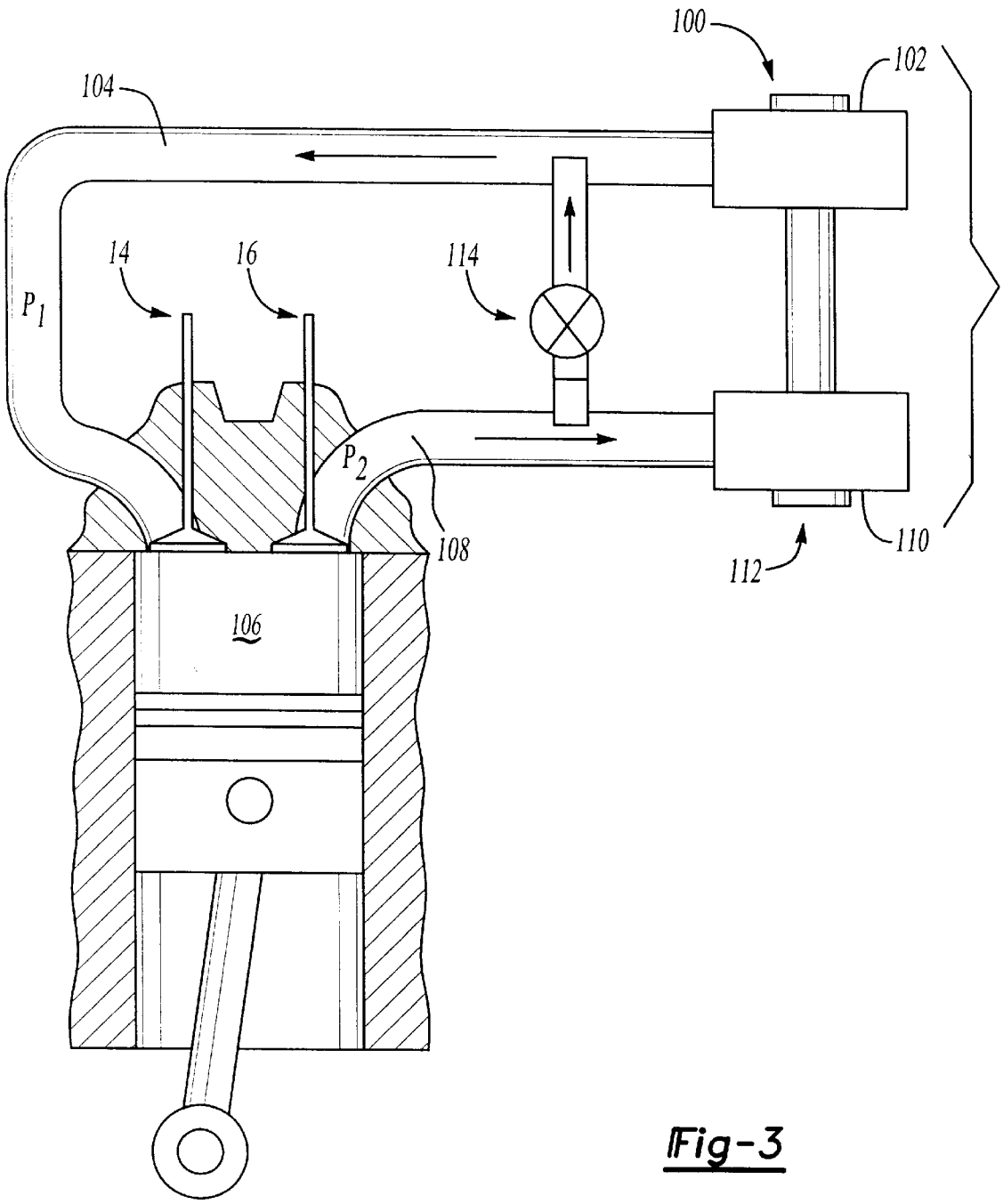
FIG. 3 is a diagrammatic view of a turbocharged unthrottled engine with exhaust gas recirculation.

Additionally, some manufacturers have attempted to design a turbocharged unthrottled (i.e. diesel) engine including an exhaust gas recirculation (EGR) system, shown diagramatically in FIG. 3. In such an engine, air is drawn through an air intake 100 into a compressor 102 that feeds compressed air through an intake manifold 104 to an intake valve 14. Air within intake manifold 104 is pressurized by the compressor to a first pressure $P_1$, typically on the order of 30 psi. After the intake air is mixed with fuel and burned within cylinder 106, exhaust valve 16 opens to vent the exhaust gases from cylinder 106 into exhaust manifold 108. A portion of the exhaust gases flow across turbine 110, thereby driving compressor 102, after which the gases are discharged through exhaust port 112. However, to improve the efficiency of the engine while reducing emissions, an EGR system 114 may be used to inject a portion of the exhaust gases back into the intake manifold. Of course, to overcome the intake manifold pressure $P_1$, the pressure $P_2$ within exhaust manifold must be exceed $P_1$,. In practice, the $P_2$ must be significantly higher than $P_1$, on the order of 75–100 percent higher, to achieve reduced emissions. Thus, if the intake manifold pressure is set at 30 psi, the exhaust manifold pressure must be between 50–60 psi to achieve the desired EGR level.

Typical valve seal assemblies have been unable to withstand the increased exhaust manifold pressure, and have been found to fail in test engines. One particularly harmful failure, called "bursting", involves the elastomeric valve stem seal failing along a radial path, generally at the radially thinnest point of the elastomeric seal. To combat seal bursting, a fully-supported valve stem seal assembly is disclosed.

Figure 4:
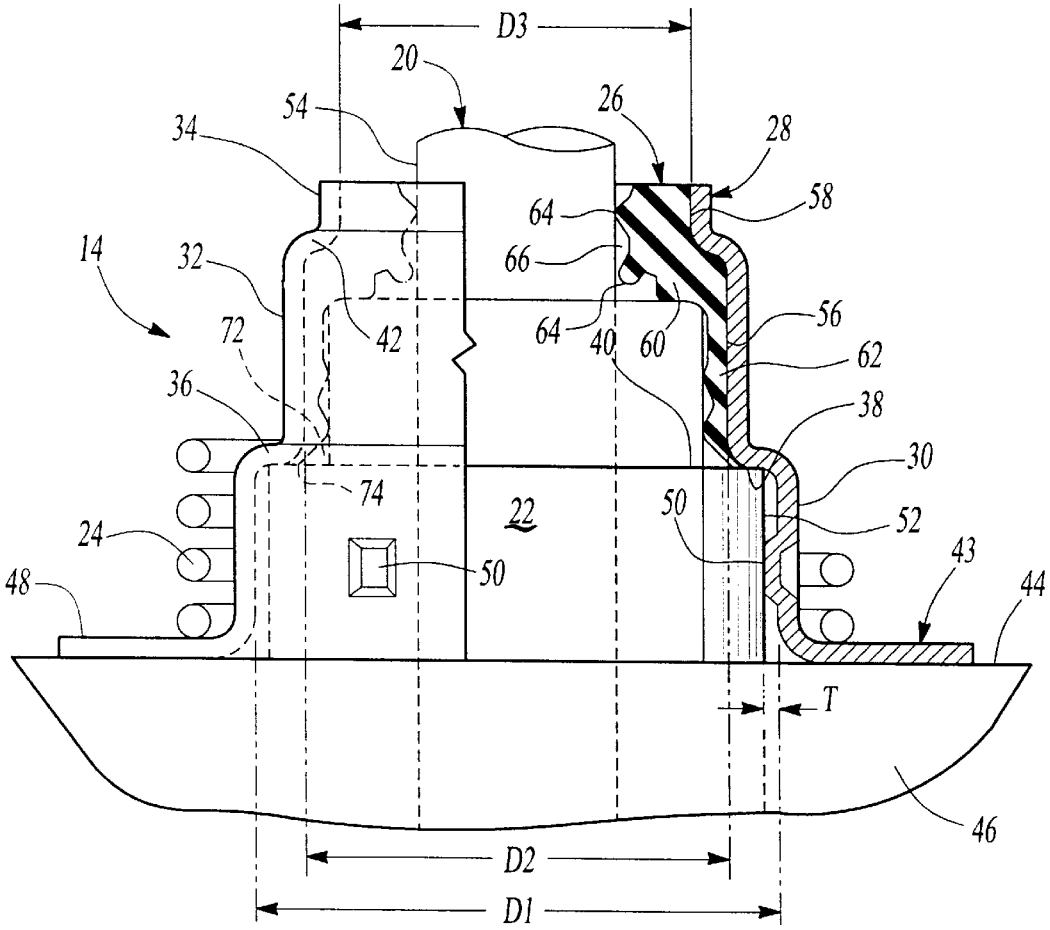
FIG. 4 is a perspective view of the valve assembly of the present invention.

A valve assembly, corresponding either to an intake valve 14 or an exhaust valve 16, is shown in FIG. 4. For purposes of the following description, the valve assembly in FIG. 4 will be referred to as an intake valve 14, but it should be understood that the following description applies to exhaust valves as well.

In general, the components that most contribute to the cross-sectional area of the valve assembly 14 include a valve stem 20, a valve guide 22, and a valve spring 24. In addition, the valve assembly further includes a valve stem seal 26 and a valve stem seal retainer 28. When assembled, the valve stem 20 is seated in and surrounded by the annular valve guide 22. In reducing the cross-sectional area of the valve assembly 14, it is generally not possible to reduce the outer diameter of the valve stem 20 for structural reasons. Instead, reducing the outer diameter of both the valve guide 22 and the valve spring 24 achieves most of the cross-sectional area reduction. However, reducing the outer diameter of the valve guide 22 results in a relatively thin-walled valve guide. It is possible that the length of the valve guide 22 might be increased to provide effective support for the valve stem 20. Unfortunately, increasing the length of the valve guide 22 results in more of the valve guide projecting above the engine head, which would require a deeper stamping operation to fabricate the valve stem seal retainer 28. However, even if the length of the valve guide 22 is not increased, it is relatively difficult for the valve stem seal 26 to remain in constant contact with the outer circumference of the valve stem 20. Moreover, it is also difficult for seal 26 to remain in constant contact with the top portion of the valve guide 22 while at the same time remaining free from interference from the valve spring 24. As seen in FIG. 4, the valve stem seal 26 is supported by the valve stem seal retainer 28. Generally, when the valve guide 22 projects upwardly a relatively large amount, the valve stem seal retainer 28 includes at least two pieces, including an upper portion for fixing the valve stem seal in place and a lower portion for preventing migration of the upper portion when the valve stem 20 reciprocates during engine operation. The lower portion may also include a flange for supporting a lower end of the valve spring 24.

According to the present invention and as shown in FIG. 4, a one-piece steel retainer 28 is provided to both support and reinforce the valve stem seal 26. Retainer 28 includes a lower portion 30, an intermediate portion 32 and an upper portion 34. Lower portion 30 is separated from intermediate portion 32 by a first transition area 36 that is located at approximately the top of valve guide 22 that serves to reduce the inner diameter of the retainer 28 between a lower diameter $D_1$ and an intermediate diameter $D_2$. First transition area 36 is preferably formed as an inwardly extending radial ledge located at approximately half the axial height of retainer 28. An inner surface 38 of the first transition area 36 is adapted to snugly rest against an upper surface 40 of the valve guide 22.

A second transition area 42 separates and reduces the inner diameter between intermediate portion 32 and upper portion 34 of retainer 28 from intermediate diameter $D_2$ to upper diameter $D_3$. Again, the second transition area 42 is preferably formed as a generally inwardly extending radial ledge that serves to support seal 26 in place and prevent lifting of the seal from contact with upper surface 40 of guide 22. Lower portion 30 of the retainer 28 further includes a radially outwardly projecting annular flange 43 that acts to locate the retainer 28 against the upper surface 44 of the cylinder head 46. An upper surface 48 of the flange 43 acts as a seat for a lower end of the valve spring 24. By including the flange 43 with the valve stem seal retainer 28, the valve seal may be fabricated and installed as a single subassembly comprising the valve stem seal 26, the valve stem seal retainer 28, and the spring 24. The sealing subassembly is easier to install, especially given the space constraints above the cylinder bore as described above.

Likewise, because the retainer 28 is unitary in construction, the inner diameter $D_1$ of the retainer 28 lower portion 30 is less than if the retainer lower portion were a separate piece. Additionally, the retainer lower portion may include a plurality of radially inwardly projecting indentations or tangs 50 that act to secure the retainer to the outer surface 52 of the valve guide 22. The tangs 50 also act to prevent the valve seal retainer 28 from lifting or rotating as the valve reciprocates during engine operation.

As noted above, an annular, elastomeric valve stem seal 26 engages the outer circumference 54 of the valve stem 20 to provide a tight seal. A lower outer circumference 56 of seal 26 is supported by and bonded to an inner circumference of intermediate retainer portion 32, while a seal upper outer circumference 58 is supported by and bonded to an inner circumference of upper retainer portion 34. An inner circumference of second transition area 42 is also bonded to seal 26, and prevents upward movement of the seal under high pressures.

In practice, the valve stem seal 26 includes an upper seal 60 and a lower seal 62. The upper seal 60 includes a plurality of continuous ribs 64 defining a number of recesses 66 in the face of the seal 26. The fingers 64 contact the outer circumference 54 of the valve stem 20 to prevent ingress of excessive amounts of lubricant, while the recesses 66 provide a reservoir of lubricant to the valve stem as well as a location for excess oil to flow.

The lower portion 62 of the valve stem seal 26 includes a frustoconical end 72 that extends axially downwardly from the upper seal to contact the upper surface 40 of the valve guide. The outer diameter of the base 74 of the frustoconical end 72 is substantially equal to or slightly larger than $D_2$, the inner diameter of the retainer intermediate portion 32 and is therefore greater than the inner diameter $D_3$ of the retainer upper portion 34, so that the valve stem seal 26 is tightly held against the valve stem outer circumference 54. By configuring the valve stem seal in this manner, the amount of elastomeric material needed to create effective sealing is reduced over conventional two-piece valve stem seal assemblies, thereby allowing for a seal having a reduced diameter. Moreover, when properly installed, second transition area 42 exerts a downward force on seal 26 such that end 72 maintains contact with surface 40 even when subjected to high pressures tending to lift the seal from the valve guide. Finally, the upper portion 34 of retainer 28 helps to prevent deformation of the seal 26 over its lifetime.

The combination of the above-described features therefore enables construction of a valve seal assembly for use with valve guides 22. The shape of the valve seal retainer allows an extremely small clearance T between the lower portion 30 of the retainer 28 and the outer surface 52 of the valve guide 22. At the same time, the flange 43 on retainer lower portion 30 provides an integral spring seat for use with a valve spring 24. Integral flange 43 and spring 24 also cooperate to maintain the seal in position on the guide under high pressure conditions that may tend to lift the seal from the guide. The valve seal subassembly of the present invention therefore provides a more compact assembly while not compromising sealability or durability of the seal, and at the same time providing a high resistance against seal failure due to bursting.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. An integral valve stem seal subassembly comprising:

a valve spring;

a unitary metal annular valve seal retainer including lower, intermediate and upper annular portions, wherein the inner diameter of said upper portion is less than the inner diameter of said intermediate portion, and the inner diameter of said intermediate portion is less than the inner diameter of said lower portion, a flange extending radially outwardly of said lower portion for engaging at least one coil of said valve spring; and an annular sealing member having upper and lower seals, said sealing member bonded to said retainer intermediate and upper portions, said upper seal including an inner circumferential surface for sealing engagement with an outer surface of a valve stem, said lower seal including a frustoconical end extending axially from said upper seal to contact a top portion of a valve guide.

2. The valve stem seal subassembly of claim 1, wherein said lower and intermediate portions are separated by a first transition area and said intermediate and upper portions are separated by a second transition area, wherein said first and second transition areas are generally inwardly extending radial ledges.

3. The valve stem seal assembly of claim 2, wherein said first transition area is formed at approximately said top portion of said valve guide.

4. The valve stem seal assembly of claim 3, wherein said first transition area is formed at approximately one-half the height of said valve seal retainer.

5. The valve stem seal assembly of claim 4, where said retainer lower portion further includes a plurality of radially inwardly extending tangs to positively engage an outer surface of the valve guide.

6. The valve stem seal assembly of claim 4, wherein an entire outer diameter of said sealing member is supported by said retainer.

7. The valve stem seal assembly of claim 6, wherein said sealing member extends about one-half the height of said retainer.

8. The valve subassembly as in claim 1, wherein said upper seal comprises a plurality of inwardly projecting continuous ribs in sealing engagement with said valve stem outer surface, said fingers defining a plurality of recesses therebetween.

9. In a valve assembly of a heavy-duty engine, an integral valve stem seal subassembly comprising:

a valve spring;

a unitary metal annular valve seal retainer defining a first height, said retainer including lower, intermediate and upper annular portions, wherein said lower portion extends about one-half said first height, wherein the inner diameter of said upper portion is less than the inner diameter of said intermediate portion, and the inner diameter of said intermediate portion is less than the inner diameter of said lower portion, a flange extending radially outwardly of said lower portion for engaging at least one coil of said valve spring; and an annular sealing member having upper and lower seals, said sealing member bonded to said retainer intermediate and upper portions such that an entire outer diameter of said sealing member is supported by said retainer, said upper seal including an inner circumferential surface for sealing engagement with an outer surface of a valve stem, said lower seal including a frustoconical end extending axially from said upper seal to contact a top portion of a valve guide.

10. The valve subassembly of claim 8, wherein said lower (30) and intermediate (32) portions are separated by a first transition area (36) and said intermediate (32) and upper (30) portions are separated by a second transition area (42), wherein said first (36) and second (42) transition areas are generally inwardly extending radial ledges.

11. The valve subassembly of claim 10, wherein a first transition area from said lower to said intermediate portion is formed at approximately said top portion of said valve guide.

12. The valve subassembly of claim 10, where said retainer lower portion further includes a plurality of radially inwardly extending tangs to positively engage an outer surface of the valve guide.

* * * * *

UNITED STATES PATENT AND TRADEMARK OFFICE

CERTIFICATE OF CORRECTION

PATENT NO. : 6,244,235 B1
DATED : June 12, 2001
INVENTOR(S) : Timothy Alan Hegemier et al.

It is certified that error appears in the above-identified patent and that said Letters Patent is hereby corrected as shown below:

Column 8,
Line 13, replace "(30) and intermediate (32)" with -- and intermediate --.
Line 14, replace "(36) and said intermediate (32)" with -- and said intermediate --.
Line 15, replace "(30) portions are separated by a second transition area (42)" with -- portions are separated by a second transition area --.
Line 16, replace "(36) and second (42)" with -- and second --.

Signed and Sealed this

Twenty-fifth Day of December, 2001

*Attest:*

*Attesting Officer*

JAMES E. ROGAN
*Director of the United States Patent and Trademark Office*